US005134989A

United States Patent [19]

Akahane

[11] Patent Number: 5,134,989

[45] Date of Patent: Aug. 4, 1992

[54] HYDRAULIC BREAKER

[75] Inventor: Ieto Akahane, Matsumoto, Japan

[73] Assignee: Izumi Products Company, Nagano, Japan

[21] Appl. No.: 628,909

[22] Filed: Dec. 18, 1990

[30] Foreign Application Priority Data

Jan. 10, 1990 [JP] Japan ..... 2-3174

[51] Int. Cl.[5] ..... B25D 9/18

[52] U.S. Cl. ..... 125/40; 125/23.01; 173/134; 173/135

[58] Field of Search ..... 125/23.01, 23.02, 40, 125/39, 38; 144/193 A, 193 D; 175/135, 296; 173/134, 135

[56] References Cited

U.S. PATENT DOCUMENTS

| | | | |
|---|---|---|---|
| 4,646,854 | 3/1987 | Arndt et al. | 173/134 |
| 4,784,228 | 11/1988 | Ito | 173/134 |
| 4,817,737 | 4/1989 | Hamada et al. | 173/134 |
| 4,852,664 | 8/1989 | Terada et al. | 173/134 |
| 4,951,757 | 8/1990 | Hamada et al. | 173/134 |

*Primary Examiner*—Bruce M. Kisliuk
*Assistant Examiner*—John A. Marlott
*Attorney, Agent, or Firm*—Cushman, Darby & Cushman

[57] ABSTRACT

A hydraulic breaker includes a piston which is designed in the five-staged configuration including a first stage, a second stage, a third stage, a fourth stage and a fifth stage. The second stage is dimensioned to have a largest diameter, the fourth stage is dimensioned to have a larger diameter and the first stage, the third stage and the fifth stage are dimensioned to a same smallest diameter, respectively. A piston reversing chamber, a low pressure hydraulic chamber in which low pressure is normally present for the piston, a low speed pilot chamber for driving the piston at a low speed, a high speed pilot chamber for driving the piston at a high speed and a high pressure hydraulic chamber in which high pressure is normally present for the piston are sequentially formed in the space between the piston and the inner wall surface of a cylinder. A high pressure oil inlet port is communicated with high pressure hydraulic passages via a plunger type main valve for changing the direction of transmission of the hydraulic pressure so as to suppress variation of surge pressure in the high pressure hydraulic passages. In addition, a low pressure oil discharge outlet port is communicated with a low pressure hydraulic passage so as to suppress variation of surge pressure in the low pressure hydraulic passage.

4 Claims, 3 Drawing Sheets

HYDRAULIC BREAKER

BACKGROUND OF THE INVENTION

1. Field of the Invention

The present invention relates generally to a hydraulic breaker. More particularly, the present invention relates to an improvement of the hydraulic breaker wherein a piston is dynamically displaced in upward and downward directions by hydraulic pressure, and nitrogen gas pressure the piston imparts a large striking force on a chisel disposed below the piston so as to break a substance, e.g., a rock, a concrete block or the like, at the end of a downward stroke of the piston.

2. Description of the Related Art

Conventional hydraulic breakers are of two basic designs. One, a hydraulically driven type wherein a piston is driven directly by hydraulic pressure, and two a gas or spring intervention type wherein nitrogen gas or a spring is forced into a compressed state in a cylinder by the upward movement of the piston and then expands and imparts a large striking force to a chisel. Both types of conventional hydraulic breaker are equipped with accumulators for the hydraulic pipings on the high pressure side located on the oil feed side. In addition, breakers are equipped with accumulators for pipings on the low pressure side located on the oil discharge side, the purpose of the accumulators is to prevent pressure pulsation in the pipings. However, it has been found that the accumulators often malfunction due to leakage of gas. For this reason, it is necessary to inspect and replace accumulators often. Therefore, the conventional hydraulic breaker has problems that lead to high maintenance costs and low operating efficiencies. Additionally, hydraulic breakers with accumulators are expensive to manufacture. In view of the foregoing problems, some solutions have been attempted such that a constant quantity of high pressure oil flows through hydraulic passages on the high pressure side and a constant quantity of low pressure oil likewise flows through hydraulic passage on the low pressure side during a step of upward displacement of the piston as well as a step of downward displacement of the piston for the purpose of eliminating a necessity for accumulators. In spite of the foregoing solutions, however, the main valve is complicated in structure and the piston is unavoidably designed to have a long length in operative association with a cylinder having a long sleeve. This leads to another problem of scratching of the piston and cylinder during sliding movement of the piston relative to the cylinder sleeve. One accumulator type conventional hydraulic breaker is disclosed in U.S. Pat. No. 4,817,737. According to this prior invention, the hydraulic breaker is constructed such that a second stage of the piston is dimensioned to have a diameter smaller than that of a fourth stage. With this design, however, the breaker cannot be assembled unless the cylinder sleeve is longer than the working stroke of the piston. The long cylinder sleeve increases the cost of manufacturing the breaker. In addition, because it is difficult to maintain, concentricity with respect to the cylinder and the piston using a long piston and cylinder, scratching of the piston and cylinder sleeve is more common. Another deficiency of the prior art is the arrangement of a nitrogen gas chamber directly above the upper high hydraulic pressure chamber. This leads to oil leaks from the high pressure chamber into the nitrogen chamber which causes the piston to incorrectly operate. A lost deficiency of the conventional breaker is that the piston is normally biased in the downward direction by high pressure, thus the operator can not raise up the chisel manually to the position where the piston starts its movement. Thus, it is difficult to perform a so-called chipping operation.

As previously explained, conventional hydraulic breakers suffer from the following deficiencies:

1) accumulators which are costly to manufacture and maintain;

2) main valve structure which is complicated and expensive to manufacture and maintain;

3) long piston and cylinder sleeve which is expensive to manufacture and is costly to maintain;

4) gas and oil chamber configurations which lead to oil leakage; and 5) inability to manually raise chisel to perform chipping operations.

SUMMARY OF THE INVENTION

The present invention has been made with the foregoing background in mind.

An object of the present invention is to provide a hydraulic breaker including a plunger type main valve wherein the aforementioned problems inherent to the conventional hydraulic breaker are solved satisfactorily.

Another object of the present invention is to provide a hydraulic breaker including a plunger type main valve with a substantially simplified structure.

According to the present invention, the hydraulic breaker is composed of a cylinder body, a valve box body and an impact rate changing valve.

A piston is slidably received in a cylinder. As a high pressure oil flows in high pressure hydraulic passages via a high pressure oil inlet port, the position of the main valve is alternately changed, whereby the piston is raised and up and lowered to repeat a striking operation. Nitrogen gas is enclosed in a nitrogen gas chamber which is disposed above the piston. When a striking operation is performed, high hydraulic pressure and high nitrogen gas pressure are exerted on the piston to impart a large striking force to the chisel thereby to break or crush a substance, e.g., a rock, or a concrete block or the like. An impact rate changing valve is attached to the valve box. The impact rate changing valve is normally kept closed. By manually opening it, the working stroke of the piston is shortened to increase the rate of impacts. This operation also a changes the magnitude of the striking force. Since the this valve makes it possible for an operator to simply change between low speed operation and high speed operation and vice versa. The hydraulic breaker of the present invention does not operate with high pressure oil introduced into high pressure hydraulic passages, until the piston is first raised up to a predetermined position via the chisel. This means that the hydraulic breaker is constructed so as to reliably prevent an idle striking operation.

Specifically, the aforementioned objects of the present invention have been accomplished in such a manner that the piston is slidably received in the cylinder, the chisel is disposed below the piston, the nitrogen gas chamber is arranged above the piston so as to allow the piston to be displaced in the downward direction by a combination of hydraulic pressure and nitrogen gas pressure during a stroke of downward movement of the piston thereby to impart a large striking force to the chisel, when the piston reaches the lowermost end, the plunger type main valve integrated with the cylinder is arranged to change the hydraulic passages for the introduced hydraulic oil.

The piston is designed in the five-staged configuration including a first stage, a second stage, a third stage, a fourth stage, and a fifth stage. The first stage is dimensioned to have a diameter smaller than that of the second stage, and the stepped surface therebetween serves as an upper pressure receiving surface. The third stage is dimensioned to have a diameter smaller than that of the second stage, and the third stage is dimensioned to have the same diameter as that of the first stage. The fourth stage is dimensioned to have a diameter larger than that of the third stage but smaller than that of the second stage. The fifth stage is dimensioned to have the same diameter as that of the first stage and the third stage. The stepped surface between the fourth stage and the fifth stage serves as a lower high pressure receiving surface. Namely, the piston is constructed such that the second stage is dimensioned to have the largest diameter, the fourth stage is dimensioned to have the second largest diameter and the first stage, the third stage and the fifth stage are dimensioned to have the same smallest diameter.

In addition, a piston reversing chamber, a low hydraulic pressure chamber in which low hydraulic pressure is normally present for the piston, a pilot chamber for driving the piston at a low speed, a pilot chamber for driving the piston at a high speed, and a high hydraulic pressure chamber in which high hydraulic pressure is normally present for the piston are sequentially formed in the space between the piston and the inner wall surface of the cylinder. With the arrangement of the chambers made in the above-described manner, the low hydraulic pressure chamber communicates with a low pressure hydraulic passage between the third stage of the piston and the inner wall surface of the cylinder so that the low pressure hydraulic passage is communicated with a low pressure output port via the main valve during downward displacement of the piston as well as during upward displacement of the piston.

While the impact rate changing valve is kept closed, the low speed pilot chamber between the fourth stage of the piston and the inner wall surface of the cylinder communicates with a high pressure flow passage between the fourth stage of the piston and the inner wall surface of the cylinder during upward displacement of the piston. Then, when the piston is displaced in the downward direction, the low speed pilot chamber communicates with the low pressure passage.

If the impact rate changing valve is opened, the high speed pilot chamber between the fourth stage of the piston and the inner wall surface of the cylinder is closed with the piston during a step of upward displacement of the piston, interrupting communication with the low speed pilot chamber. At this time, the high speed pilot chamber communicates with the high pressure passage between the fourth stage of the piston and the inner wall surface of the cylinder. On completion of downward displacement of the piston, the high speed pilot chamber communicates with the low speed pilot chamber via a hydraulic passage.

As the piston is displaced in the downward direction, the connection between the low speed pilot chamber and the low pressure hydraulic passage is interrupted, whereby the piston is intensely displaced in the downward direction by the force derived from high hydraulic pressure active on the upper pressure receiving surface and the force derived from the compressed nitrogen gas.

Other objects, features and advantages of the present invention will become apparent from reading the following description and referring to the accompanying drawings.

BRIEF DESCRIPTION OF THE DRAWINGS

The present invention is illustrated in the following drawings in which.

DESCRIPTION OF THE PREFERRED EMBODIMENT

Now, the present invention will be described in detail with reference to the accompanying drawings which illustrate a preferred embodiment of the present invention.

Figure 1:
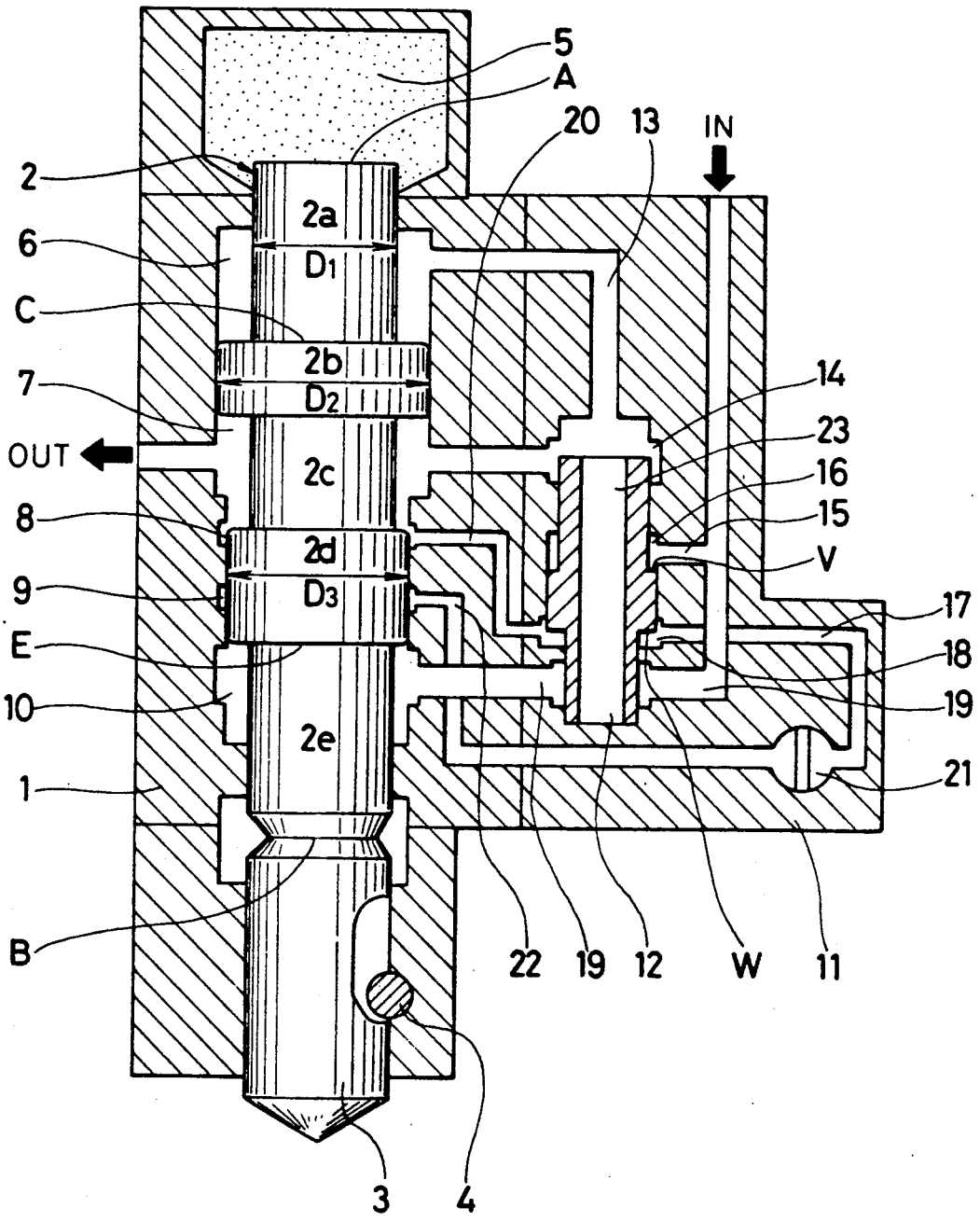
FIG. 1 is a sectional view of a hydraulic breaker in accordance with an embodiment of the present invention.

As shown in FIG. 1, the hydraulic breaker of the present invention comprises a cylinder 1, a piston 2 slidably received in the cylinder 1, a chisel 3 fitted into the cylinder 1 to come in contact with the bottom of the piston 2 and a chisel pin 4 for preventing the chisel 3 from being disconnected from the cylinder 1. In addition, the hydraulic breaker includes a nitrogen gas chamber 5 above the piston 2 so that nitrogen is accumulated in the nitrogen gas chamber 5.

The piston 2 is designed in a five-staged configuration including a first stage 2*a*, a second stage 2*b*, a third stage 2*c*, a fourth stage 2*d* and a fifth stage 2*e*. The first stage 2*a*, the third stage 2*c* and the fifth stage 2*e* have the same diameter $D_1$. The second stage 2*b* has the largest diameter $D_2$ and the fourth stage 2*d* has a diameter $D_3$ which is larger than $D_1$ and smaller than $D_2$. Accordingly, the following inequality (1) is established among the three diameters $D_1$, $D_2$ and $D_3$.

$$D_1 < D_3 < D_2 \quad (1)$$

The upper surface of the first stage 2*a* is a nitrogen gas pressure receiving surface A and the bottom surface of the fifth stage 2*e* is a striking surface B for the chisel 3. The upper surface of the second stage 2*b* is a pressure receiving surface C, and the lower surface of the fourth stage 2*d* is a pressure receiving surface E. The cross-sectional area relationship between the above two pressure receiving surfaces is set to establish the following inequality (2).

$$C > E \quad (2)$$

A piston reversing chamber 6, a low hydraulic pressure chamber 7, located below the piston reversing chamber 6 in communication with low hydraulic pressure passage so as to allow low hydraulic pressure to be normally exerted on the piston 2, and a pilot chamber 8 located below the low hydraulic pressure chamber 7 for driving the piston 2 at a low speed, are sequentially formed between the piston 2 and the inner wall surface of the cylinder 1. A valve box 11, having a plunger type main valve 12 incorporated therein for driving the piston 2 by changing the direction of transmission of hydraulic pressure, is integrated with the cylinder 1 on the right-hand side of the piston 2.

The main valve 12 is slidably received in the valve box 11. The upper part of the main valve 12 communicates with a hydraulic passage 13 via pressure chamber 14 in which low hydraulic pressure is normally present for the main valve 12. The intermediate part of the main valve 12 communicates with a high hydraulic pressure passage 15 via a pressure chamber 16 in which high hydraulic pressure is normally present for the main valve 12. The lower part of the main valve 12 communicates with a low hydraulic pressure passage 17 via a main valve pilot chamber 18, and the lowermost part of the main valve 12 communicates with a high hydraulic pressure passage 19. The interior of the main valve 12 is a hollow hydraulic passage 23 coaxial with main valve 12.

An upper pressure receiving surface V is formed outside of the middle part of the main valve 12 to define the high hydraulic pressure chamber 16 in which high hydraulic pressure is normally present for the main valve 12. In addition, a lower pressure receiving surface W is formed outside of the lower part of the main valve 12 to define the main valve pilot chamber 18.

The foregoing description illustrates the significant feature of a very simple construction compared with conventional hydraulic breakers.

Next, the operation of the hydraulic breaker of the present invention as constructed in the above-described manner will be described.

Figure 2A:
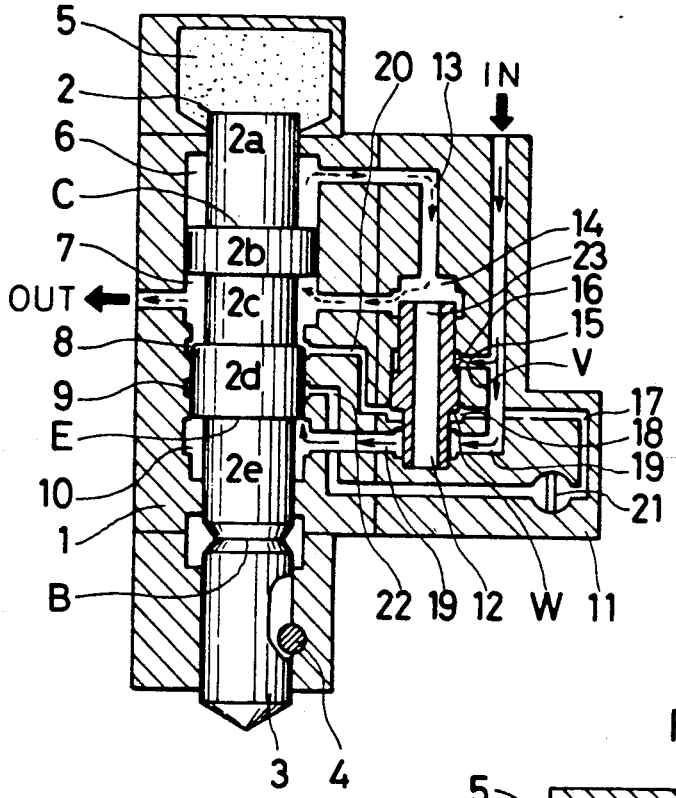
FIGS. 2(A) to (D) are sectional views of the hydraulic breaker in FIG. 1, particularly illustrating stages of operation of the hydraulic breaker.
Figure 2B:
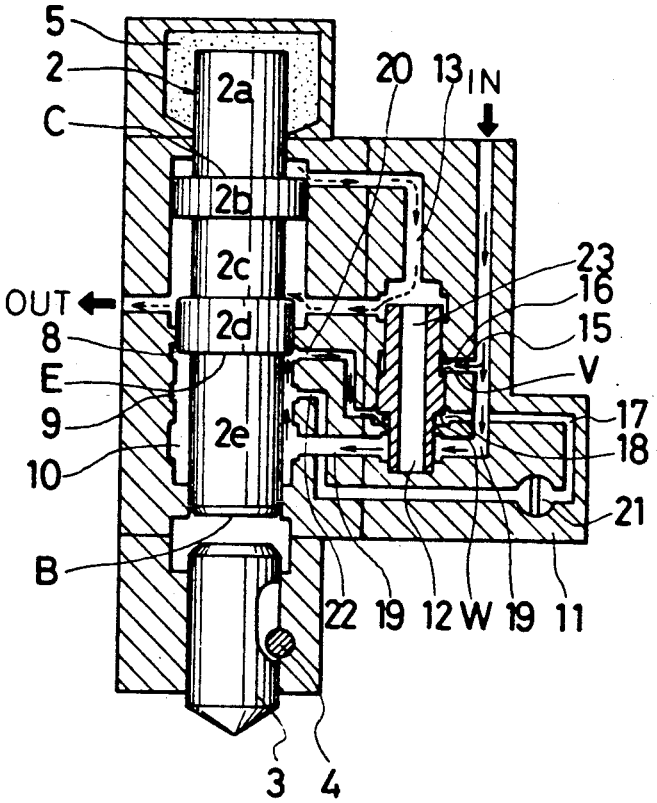

First, high pressure oil is introduced into the interior of the hydraulic breaker via a high pressure oil inlet port IN; oil enters the high pressure hydraulic chamber 16 via hydraulic passage 15 and the high pressure of the hydraulic oil is exerted on the upper pressure receiving surface V of the main valve 12, whereby the main valve 12 is downwardly displaced toward a lower dead point (see FIG. 2(A)). The introduced high pressure oil also reaches the lower high pressure receiving surface E of the piston 2; i.e., the stepped surface at the boundary between the fourth stage 2*d* and the fifth stage 2*e* of the piston 2. The lower high pressure receiving surface E is exposed to a high pressure hydraulic chamber 10 in the cylinder 1. Since the upper pressure receiving surface C of the piston 2 is communicated with the hydraulic passage 13 at this time, the piston 2 is raised up by the high pressure exerted on the lower high pressure receiving surface E with the result that the piston 2 is displaced in the upward direction. When the lower end of the fourth stage 2*d* reaches the low speed pilot chamber 8 and the piston 2 reaches the upper dead end, the low speed pilot chamber 8 communicates with the outer peripheral surface of the fifth stage 2*e* of the piston 2 to form a high pressure hydraulic passage (see FIG. 2(B)). Then, the high pressure oil flows to the main valve 12 via hydraulic passage 20 extending from the low speed pilot chamber 8 so as to allow the high hydraulic pressure to be exerted on the lower pressure receiving surface W of the main valve 12.

It should be noted that the piston 2 reaches the high speed pilot chamber 9 before it reaches the upper dead point but, since no high hydraulic pressure is exerted on the lower pressure receiving surface W of the main valve 12 because an impact number changing valve 21 is kept closed at this time, the main valve 12 is not raised up no matter how the high pressure oil flows into hydraulic passage 22. Therefore, the piston 2 continues to be raised up further.

Figure 2C:
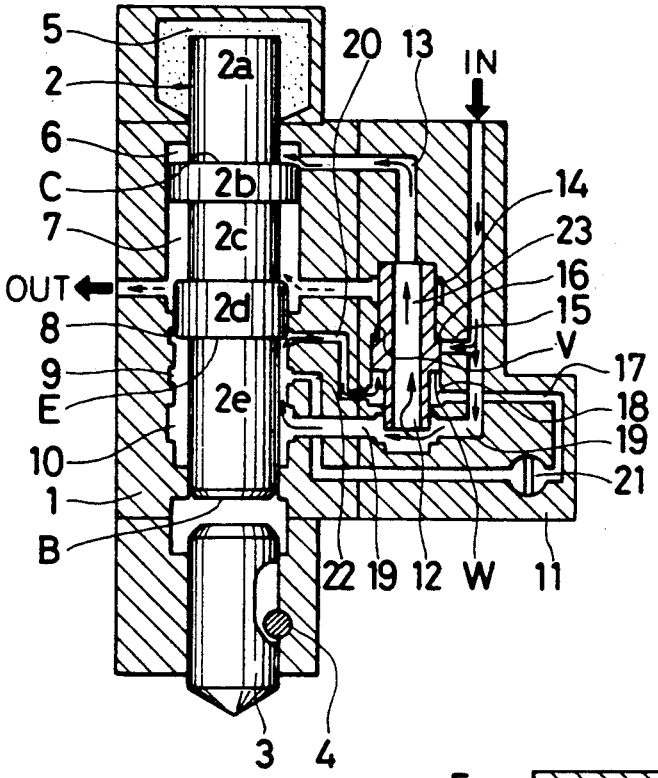

When the low speed pilot chamber 8 communicates with the hydraulic passage 20 via the high pressure chamber 10, the high hydraulic pressure is exerted on the lower pressure receiving surface W of the main valve 12 so that the main valve 12 is displaced in the upward direction by the force of the hydraulic pressure active on surface W and surface V because the area surface W is greater than that of surface V (see FIG. 2(C)).

Figure 2D:
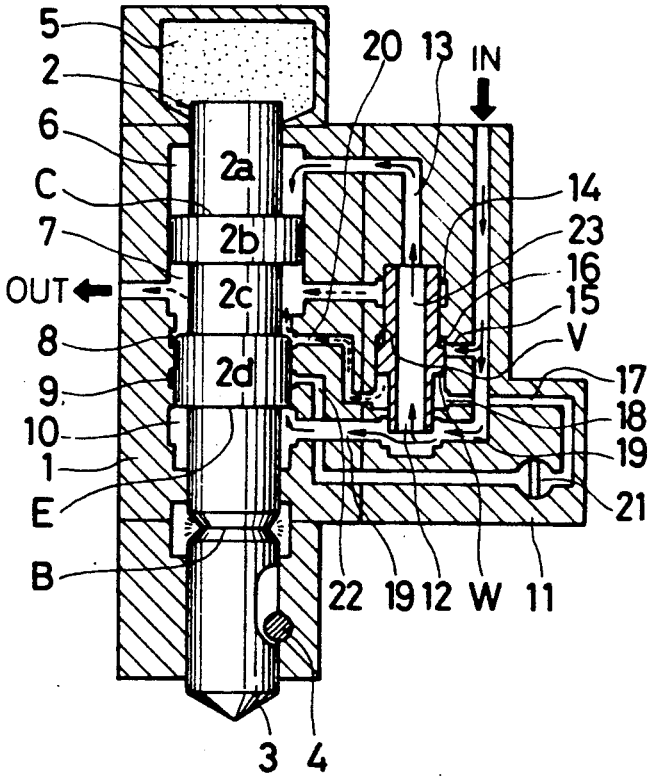

When the main valve 12 is displaced to the upper dead end, part of the high pressure oil introduced into the interior of main valve 12 via the high pressure oil inlet port IN enters the piston reversing chamber 6 via the lower end of the main valve 12, the hydraulic passage 23 in the main valve 12, and the hydraulic passage 13, whereby the high hydraulic pressure is exerted on the pressure receiving surface C of the piston 2 in the piston reversing chamber 6. This causes the piston 2 to be displaced in the downward direction by the force derived from the hydraulic pressure active on the differential area between the upper pressure receiving surface C in the piston reversing chamber 6 and the pressure receiving area E in the high hydraulic pressure chamber 10 having an area smaller than that of the former (see FIG. 2(D)). Since the outer peripheral surface of the third stage 2C communicates with a low pressure oil discharge port OUT at this time, the hydraulic pressure in the space defined by the outer peripheral surface of the third stage 2*c* of the piston 2 and the inner wall surface of the cylinder is quickly reduced. In response to the quick reduction of the hydraulic pressure, the piston 2 is intensely displaced in the downward direction by a large magnitude of force derived from a sum of the pressure of compressed nitrogen gas in the nitrogen gas chamber 5 acting on surface A and the high hydraulic pressure exerted on the upper pressure receiving surface C of the piston 2 until the piston 2 intensely strikes the chisel 3. After the downward displacement of the piston 2, the low pressure oil in the space between the third stage 2*c* of the piston 2 and the cylinder 1 is discharged via the low pressure oil discharge port OUT.

When the piston 2 is downwardly displaced to the lower dead point thereby to impart a large magnitude of striking force to the chisel 3, the high pressure oil is introduced into pressure chamber 10 via the hydraulic passage 19. On the other hand, the high pressure oil active on the lower pressure receiving surface W of the main valve 12 is discharged to the low pressure side via the hydraulic passage 20. Since the high hydraulic pressure is normally exerted on the pressure receiving surface E of the piston 2 and the upper pressure receiving surface C of the piston 2 is communicated with the low pressure side via the hydraulic passage 13 at, the piston 2 starts to move in the upward direction. Subsequently, the aforementioned operations are performed repeatedly.

Following is a description of a means to increase the impact rate.

First, high pressure oil is introduced into the interior of the main valve 12 via the high pressure oil inlet port IN. High hydraulic pressure is exerted on the upper pressure receiving surface V of the main valve 12, whereby the main valve 12 is displaced in the downward direction to reach the lower dead point. At this time, since the high hydraulic pressure is normally exerted on the pressure receiving surface E of the piston 2 and the pressure receiving surface C of the piston 2 communicates with the low pressure side, the piston 2 starts to move in the upward direction.

When the piston 2 is raised up and thereby the high speed pilot chamber 9 is exposed to the high pressure chamber 10 while the impact rate changing valve 21 is kept opened, the high hydraulic pressure is exerted on the lower pressure receiving surface W of the main valve 12 via the hydraulic passage 17. Since the lower pressure receiving surface W of the main valve 12 has an area larger than that of the upper pressure receiving area V of the same, the main valve 12 is displaced in the upward direction by the force derived from the hydraulic pressure active on the differential area therebetween. When the main valve 12 reaches the upper dead point, the high hydraulic pressure is exerted on the upper pressure receiving surface C via the hydraulic passage 19, the hydraulic passage 23 in the main valve 12 and the hydraulic passage 13. Since the upper pressure receiving surface C of the piston 2 has an area larger than that of the lower pressure receiving surface E of the same, the piston 2 is displaced in the downward direction by the force derived from the hydraulic pressure active on the differential area therebetween. When the piston 2 reaches the lower dead point thereby to impart a large magnitude of striking power to the chisel 3, the high pressure oil on the lower pressure receiving surface W of the main valve 12 is discharged to the lower pressure side via the hydraulic pressure passage 20. Then, the main valve 12 is displaced in the downward direction, whereby the process returns to the first step. Now, the hydraulic breaker is ready to perform the aforementioned operations again.

As is apparent from the above description, the working stroke of the piston 2 can be shortened and the rate of impacts increased by opening the impact rate changing valve 21.

According to the present invention, since low pressure oil flows to the outside through the low pressure discharge port OUT during both raising and lowering of the piston 2, fluctuation of the hydraulic pressure is minimized without undesirable surges in pressure. Therefore, there is no need for an accumulator in a hydraulic circuit on the low pressure side. In addition, since the high pressure inlet port IN is always connected to a source of high pressure oil port IN at all times, surge pressure varies few in on the high pressure side of the circuit. Therefore, there is likewise no need of arranging accumulators in the hydraulic circuits on the high pressure side.

As is apparent from the description of the structure of the hydraulic breaker, since low pressure oil in the hydraulic breaker is always delivered to the low pressure outlet port during both the steps of raising and lowering the piston, surges in pressure in the low pressure side of the circuit are minimal. Therefore, there is no need for accumulators in the low pressure side. Additionally, since a high pressure oil is always required during both the steps of raising and lowering the piston, surges in pressure in the high pressure side of the circuit are minimal. Therefore, there is likewise no need for accumulators in the high pressure side.

Further, the hydraulic passage defined between the first stage of the piston and the inner wall surface of the cylinder as well as the hydraulic passage defined between the fifth stage of the piston and the inner wall surface of the cylinder are both in a high pressure state during the striking operation of the chisel so, the piston is firmly held by the high pressure oil at the both upper and lower ends, thus limiting piston vibration during the striking operation of the chisel. This reduces undesirable scratching and wear of the cylinder and piston during sliding movement relative to each other.

The cylinder sleeve is designed to have a short length while maintaining an adequate amount of annular gap between the piston and the cylinder with an excellent concentricity. This prevents more reliably the cylinder and the piston from being undesirably scratched during slidable movement relative to each other.

In contrast with the prior accumulator type hydraulic breaker as disclosed in U.S. Pat. No. 4,817,737 which is constructed such that a piston is normally biased in the downward direction by a high pressure oil, according to the present invention, the piston is normally biased in the downward direction by a small force derived from nitrogen gas. Thus, the chisel can simply manually be raised up to the position where the piston starts its striking operation. This makes it possible for the hydraulic breaker to easily perform a so-called chipping operation required for finishing a normal plane or the like.

Further, since the impact rate changing valve is designed in a cassette type, it is easy to set the hydraulic breaker to either operation at a high speed or operation at a low speed. As desired, the impact rate changing valve can be attached to the hydraulic breaker by an operator in a working site. Additionally, the impact rate can be simply changed in a working site. As a result, the practical range of usage of the hydraulic breaker is increased remarkably.

According to the present invention, the hydraulic breaker is constructed such that a constant quantity of low pressure oil and high pressure oil flows through hydraulic passages during both raising and lowering movement of the piston. Thus, very small surges in pressure occur in the hydraulic breaker of the present invention, thus simplifying the design. The simplified design reduces the number of seals and thus minimizes oil leakage and maintenance costs compared with conventional hydraulic breakers.

While the present invention has been described in its most preferred embodiment, various changes and modifications may be made without departing from the scope of the invention as defined by the appended claims.

What is claimed is:

1. A hydraulic breaker comprising;

a piston having five stages, including a first stage, a second stage, a third stage, a fourth stage, and a fifth stage, said fourth stage having a diameter smaller than that of the second stage and larger than that of the first, third, and fifth stage, said first, third and fifth stage having the same diameter, said second stage having an upper pressure receiving surface located at the boundary between the second stage and the first stage, said fourth stage having a lower pressure receiving surface located at the boundary between the fourth stage and the fifth stage;

a nitrogen gas chamber containing nitrogen, located above said piston so as to allow the piston raised up by hydraulic pressure to be intensely displaced in the downward direction by hydraulic pressure and nitrogen gas pressure;

a cylinder to change the direction of transmission of hydraulic pressure wherein the piston is slidably received;

a plunger type main valve having three stages located in a valve box adjacent to the cylinder, the main valve being displaceable in upward and downward directions, the main valve comprising a first stage, a second stage, and a third stage, the diameter of said second stage being larger than the diameter of said first stage, the diameter of said first stage being larger than the diameter of said third stage, an upper pressure receiving surface at the boundary between the first and second stages, and a lower pressure receiving surface at the boundary between the second and third stages, the lower pressure receiving surface having an area greater than the upper pressure receiving surface;

a piston reversing chamber, a low hydraulic pressure chamber in which low hydraulic pressure is present for the piston, a low speed pilot chamber for driving the piston at low speed, a high speed chamber for driving the piston at a high speed, and a high hydraulic pressure chamber in which high hydraulic pressure is normally present for the piston, these chambers are sequentially formed in the space between the piston and an inner wall surface of the cylinder, said high pressure chamber is connected to a high pressure oil inlet port and to high hydraulic pressure passages via said main valve during a step of upward displacement and downward displacement of the piston to avoid surges in pressures in low hydraulic pressure passages;

a hydraulic connecting passage formed between the first stage of the piston and the inner wall of the cylinder, said hydraulic connecting passage being connected to high hydraulic pressure passages via the main valve during the step of downward displacement of the piston, and being connected to low hydraulic pressure passages via the main valve during the step of upward displacement of the piston, such that, the piston is displaced in the downward direction by high hydraulic pressure exerted on the upper pressure receiving surface via the main valve and by compressed nitrogen in the nitrogen gas chamber, the piston is displaced in the upward direction by high hydraulic pressure exerted on the lower pressure receiving surface via the main valve, thus, limiting surges in pressure in the high hydraulic pressure passages because of the necessity for high pressure oil during both the step of upward and downward displacement of the piston; and an impact rate changing valve, attached to the valve box, which opens or closes a hydraulic impact rate passage between the main valve and the high speed pilot chamber to change an impact rate of the piston.

2. A hydraulic breaker as claimed in claim 1 wherein said main valve has two positions; a downward position and on upward position, such that:

when the main valve is in said downward position, high pressure oil flows post the third stage of the main valve and enters said high hydraulic pressure chamber, raising the piston in an upward direction;

when the main valve is in said upward position, high pressure oil flows through a channel located axially within the main valve and enters the piston reversing chamber, forcing the piston in the downward direction.

3. A hydraulic breaker as claimed in claim 2 wherein said main valve is alternately moved from the downward position to the upward position by high pressure oil acting alternatively on the upper pressure receiving surface and lower pressure receiving surface.

4. A hydraulic breaker as claimed in claim 1 wherein said main valve is alternately moved from the downward position to the upward position by high pressure oil acting alternatively on the upper pressure receiving surface and lower pressure receiving surface.

* * * * *